US008170249B2

(12) United States Patent
Halteren

(10) Patent No.: US 8,170,249 B2
(45) Date of Patent: May 1, 2012

(54) HEARING AID HAVING TWO RECEIVERS EACH AMPLIFYING A DIFFERENT FREQUENCY RANGE

(75) Inventor: Aart Zeger Van Halteren, Hobrede (NL)

(73) Assignee: Sonion Nederland B.V., Amsterdam (NL)

( * ) Notice: Subject to any disclaimer, the term of this patent is extended or adjusted under 35 U.S.C. 154(b) by 1350 days.

(21) Appl. No.: 11/811,991

(22) Filed: Jun. 13, 2007

(65) Prior Publication Data

US 2007/0291971 A1 Dec. 20, 2007

Related U.S. Application Data

(60) Provisional application No. 60/814,858, filed on Jun. 19, 2006.

(51) Int. Cl.
*H04R 25/00* (2006.01)

(52) U.S. Cl. ..... 381/322; 381/312; 381/328

(58) Field of Classification Search ..... 381/322, 381/328; 600/25

See application file for complete search history.

(56) References Cited

U.S. PATENT DOCUMENTS 4,548,082 A * 10/1985 Engebretson et al. ..... 73/585
4,629,833 A * 12/1986 Kern et al. ..... 381/320
6,009,183 A * 12/1999 Taenzer et al. ..... 381/330
6,072,885 A 6/2000 Stockham, Jr. et al. ..... 381/321
6,597,524 B2 * 7/2003 Sasaki ..... 359/811
6,748,094 B1 * 6/2004 Tziviskos et al. ..... 381/330
7,317,806 B2 * 1/2008 Harvey et al. ..... 381/328
2006/0159298 A1 * 7/2006 von Dombrowski et al. . 381/330

FOREIGN PATENT DOCUMENTS

EP 1 617 704 A2 1/2006

OTHER PUBLICATIONS

European Search Report corresponding to European Application No. EP 07110517.5-1224 dated Dec. 4, 2007 (4 pages).

* cited by examiner

*Primary Examiner* — Jerome Jackson, Jr.
*Assistant Examiner* — David Spalla
(74) *Attorney, Agent, or Firm* — Nixon Peabody LLP

(57) ABSTRACT

A hearing aid having two physically separate receivers, one for outputting low frequency (LF) acoustic sounds and another for outputting high frequency (HF) acoustic sounds. The LF receiver's output port is connected to a tube in which the HF receiver is inserted. The LF acoustic sounds either flow around the HF receiver, which include standoffs to space the HF receiver away from the inner tube wall, or through a channel in the HF receiver. At the output of the HF receiver, the LF and HF acoustic sounds are combined to form an acoustic signal that is transmitted to the ear canal. The LF receiver can be optimized for compliance, distortion, resonance frequency, and output. Its orientation is selected for reducing the overall size of the hearing aid. The HF receiver is smaller and placed far away from any microphone(s), reducing feedback effects, and may have a cylindrical or rectangular shape.

10 Claims, 6 Drawing Sheets

HEARING AID HAVING TWO RECEIVERS EACH AMPLIFYING A DIFFERENT FREQUENCY RANGE

CROSS REFERENCE TO RELATED APPLICATION

This application claims the benefit of U.S. Provisional Application No. 60/814,858, filed Jun. 19, 2006, titled "Hearing Aid Having Two Receivers Each Amplifying a Different Frequency Range," which is hereby incorporated by reference in its entirety.

FIELD OF THE INVENTION

This invention relates to hearing aids, and, more particularly, to a hearing aid having two receivers each amplifying a different frequency range.

BACKGROUND OF THE INVENTION

Today's hearing aids include only one receiver that, together with the hearing-aid acoustics (tubing, wax protection devices, etc.) connected to it, has a resonance frequency that lies between 2 kHz and 3.5 kHz. There are two primary reasons for this limitation. First, the un-occluded ear has significant gain in this frequency range, which is removed by blocking the open ear canal with an closed-fitting earmold. Second, in order to achieve an acceptable output and efficiency at both low and high frequencies, the resonance frequency is selected to be somewhere in the middle of the required frequency range (e.g., 300 Hz to 6 kHz). If the resonance frequency is increased above 3.5 kHz, the efficiency would be too low for the low frequencies though it would improve the response above 4 kHz considerably.

There is a trend to increase the bandwidth of the hearing aid, but this trend is particularly difficult to apply to behind-the-ear (BTE) hearing aids because the long sound tubing inserted between the receiver sound port and the sound outlet of the ear mold suppresses the high frequencies. Bandwidth enhancement in general has been limited by the available processing power of the DSPs within the hearing aid, in which the audio sampling rates typically have been limited to a sample rate of about 16 kHz with a resulting audio bandwidth slightly below 8 kHz. In the increasingly popular open-fitting "over-the-ear" (OTE) hearing aids, overall performance with respect to frequency bandwidth and efficiency can be improved by placing the receiver deeper inside the user's ear canal.

Thus, a need exists for improved hearing aids that will amplify and output substantial sound pressure in the frequency range above 8 kHz in addition to the ordinary sound pressure output in the frequency range 100 Hz to 8 kHz. The present invention is directed to satisfying one or more of these needs and solving other problems.

SUMMARY OF THE INVENTION

A receiver system for a hearing aid comprises a housing, a first receiver in the housing, a tube in the housing, and a second receiver. The first receiver amplifies low frequency sounds in at least the audible frequency range and has a first output port for outputting the low-frequency sounds. The tube is connected to the first output port. The second receiver is located at least partially in the tube and downstream of the first output port. The second receiver amplifies high frequency sounds in at least the audible frequency range.

Alternatively, the present invention is a receiver system for a hearing aid, comprising a housing, a first receiver, a sound path, and a second receiver. The first receiver is located in the housing and has a first output port for outputting low-frequency sounds. The sound path is located in the housing and has a first end connected to the first output port and a second end. The second receiver is located in the housing and has a second output port for outputting high-frequency sounds. The second end of the sound path is disposed proximate to the output port.

The invention can alternatively be considered a hearing aid comprising a housing including a first receiver for producing low-frequency acoustic output and a tube acoustically connected to an output port of the first receiver. A second receiver is outside of the housing and is acoustically coupled to the first receiver. The second receiver produces high-frequency acoustic output.

Additional aspects of the invention will be apparent to those of ordinary skill in the art in view of the detailed description of various embodiments, which is made with reference to the drawings, a brief description of which is provided below.

DETAILED DESCRIPTION OF THE INVENTION

Figure 1A:
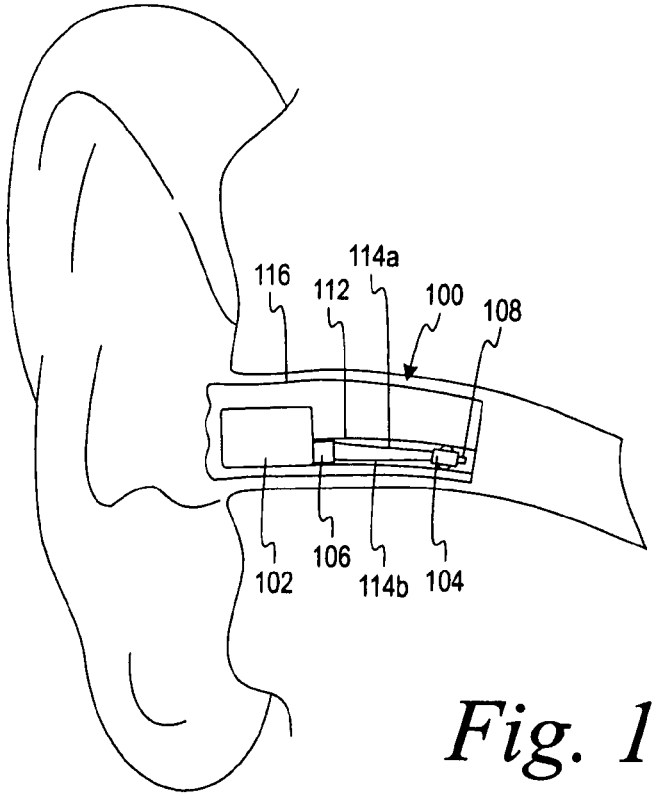
FIG. 1*a* is a side view of a device having two receivers, one disposed in a tube connected to an output port of the other.

There are at least three considerations in optimizing hearing aids in general: (1) its size should be as small as possible; (2) its power consumption should be as small as possible; and (3) its maximum sound pressure output should, as a general rule, be as high as possible. Another consideration is also becoming very important: (4) bandwidth should be as high as possible. The present invention achieves optimization of all four of the foregoing considerations by providing two receivers, each of which is separately optimized for different frequency ranges.

Though the addition of a second receiver may appear at first blush to increase overall size, in fact, each receiver can be optimized to a smaller size and can be distributed in the hearing aid in different areas or orientations, thereby saving overall space. By providing a separate receiver specially optimized at low frequencies, the resonance frequency is lowered, substantially increasing low frequency efficiency when compliance is increased. For the high frequencies, efficiency is less important because most of the energy in normal situations is related to frequencies below 500 Hz. To decrease power consumption for the high frequencies, the mass of the high-frequency receiver is lowered, which is easier to do in a device that needs to reproduce high frequencies only. Lowering the mass of the high-frequency receiver also advantageously improves acoustical feedback, which is generally only important for frequencies above about 1 kHz.

Maximum sound pressure output can be increased with separately optimized receivers because each resonance can be shifted to a frequency where maximum output is of prime importance. For the high-frequency receiver, its desired resonance may still be around the un-occluded ear resonance. But for the low-frequency receiver, its resonance can be selected to increase maximum output. Present-day balanced armature receivers are ill-suited for this sort of optimization.

The dual-receiver aspects of the present invention also permit the bandwidth to be optimized with a sufficient amount of output. A high-frequency receiver with a significantly higher resonance frequency than 3.5 kHz can achieve a usable bandwidth of up to 15 kHz. This range of bandwidth is particularly suited to address mild to moderate hearing loss as well as for use in communication devices such as mobile phones, earphones, headphones, headsets, and the like.

In an embodiment, the low-frequency receiver has a bandwidth of about 8 kHz and a high-frequency driver can be added as needed because of the positioning required within a particular hearing aid or because of the functionality needed for a particular application. This embodiment supports a platform scheme whereby certain functionality is disabled or eliminated for lower-priced variants.

As used herein, "low frequency" includes frequencies below about 1.2 kHz and "high frequency" includes frequencies above about 1.2 kHz. Very high frequencies include frequencies above about 7 kHz.

Figure 1B:
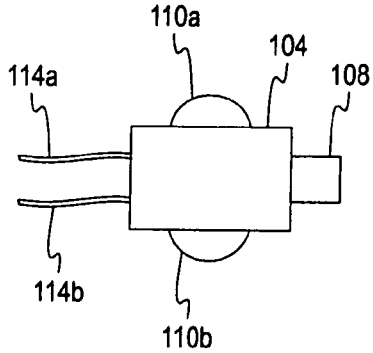
FIG. 1*b* is an illustration of a high-frequency receiver with standoffs for placement within a tube connected to an output port of a low-frequency receiver.
Figure 1C:
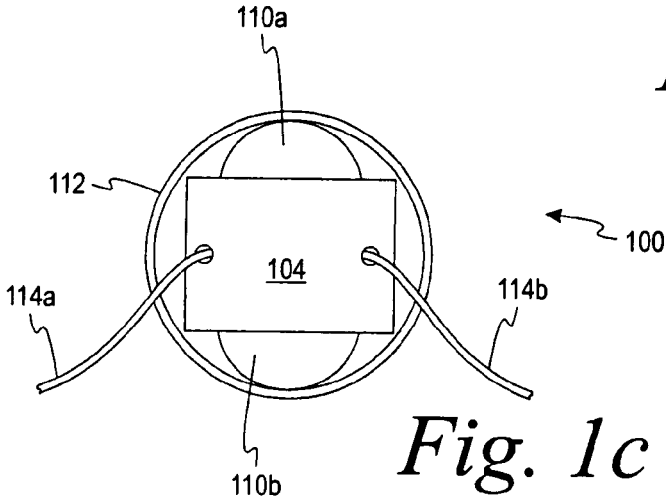
FIG. 1*c* is an end perspective view of the high-frequency receiver shown in FIG. 1*a* disposed within a tube.

Turning now to the Figures, and initially to FIGS. 1*a*-1*c*, a receiver system 100 according to an embodiment of the present invention is shown. The receiver system 100 includes a low-frequency receiver 102 and a high-frequency receiver 104 positioned within a tube 112 that is connected to an output port 106 of the low-frequency receiver 102. The interface between the tube 112 and the output port 106 forms a tight acoustical seal to prevent leakage. The low-frequency receiver 102, the high-frequency receiver 104, and the tube 112 are housed within a housing 116 that is sized to fit within an average person's ear canal. The housing 116 may contain the electronics required for operation of the receiver system 100.

The high-frequency receiver 104 includes standoffs 110*a*, 110*b* (FIGS. 1*b* and 1*c*) disposed about a periphery of the high-frequency receiver 104 such that when the high-frequency receiver 104 is positioned within the tube 112, the low-frequency acoustic sounds emanating from the output port 106 of the low-frequency receiver 102 are able to flow around the high-frequency receiver 104. High-frequency acoustic sounds are outputted from an output port 108 of the high-frequency receiver 104, which are combined with the low-frequency acoustic sounds that flow around the high-frequency receiver 104 due to the standoffs 110*a*, 110*b* shown in FIGS. 1*b* and 1*c*.

The low-frequency receiver 102 is connected to the internal electronics (e.g., the DSP) in the customary way by wires or with conductive springs. Wires 114*a*, 114*b* from the high-frequency receiver 104 extend down the tube 112 in the illustrated embodiment for connection to processing electronics (described in connection with FIG. 6 below) including a DSP. Alternately, the wires 114*a*, 114*b* may be connected to inner conductive electrodes disposed along the tube 112, which carry the electrical audio signals from the processing electronics to the wires 114*a*, 114*b*. The wires 114*a*, 114*b* are preferably very thin litze wires that can easily fit around the output port 106 of the low-frequency receiver 102 within the tube 112. In another embodiment, the standoffs 110*a,b* include conductive strips and connect to corresponding conductive electrodes formed along the interior of the tube 112 proximate where the standoffs 110*a,b* contact the tube 112. In another embodiment, the tube 112 is a flexprint having conductive traces formed along its surface for connection to the electrodes of the high-frequency receiver 104. The use of conductive portions on the tubing 12 is preferred in BTE and OTE types of hearing aids. When only one DSP is used in the system, one contact for the receivers may be acceptable, and when no capacitive filtering (crossover) for the high-frequency receiver 104 is used, both contacts for the receivers can be used.

Figure 2:
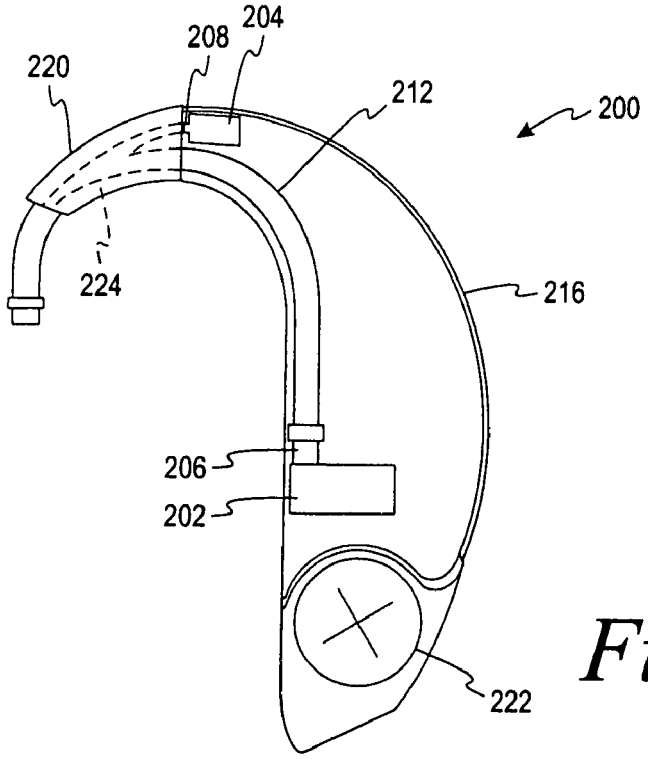
FIG. 2 is an illustration of a hearing aid shell having a low-frequency receiver coupled to an earhook by a tube and a high-frequency receiver also coupled to an earhook.

In behind-the-ear or on/over-the-ear listening-device implementations, the present invention offers great flexibility regarding the placement of the low-frequency and high-frequency receivers. In existing hearing-aid designs, a receiver is placed near the battery, which advantageously reduces overall size, but a very long tubing is required to guide the output acoustic sounds from the receiver output port to the ear canal. The long tubing causes the high frequencies to suffer. The present invention avoids this and other drawbacks by placing a high-frequency receiver near the entrance of the earhook, while the low-frequency receiver is connected by a tube to the earhook, such as shown in FIG. 2. The low frequencies are generally unaffected by the tubing length.

The hearing aid 200 shown in FIG. 2 includes a housing 216 that houses a low-frequency receiver 202 connected to a tube 212, and a high-frequency receiver 204 that is located near the entrance of an earhook 220 of the hearing aid 200. A Y-shaped tube 224 within the earhook 220 connects to an output port 206 of the low-frequency receiver 202 and to an output port 208 of the high-frequency receiver 204. In the illustrated embodiment, the tube 212 is connected to the earhook 220 just at about the same plane where the earhook 220 is connected to the hearing aid 200. The tube 224 can also have a T-shape as well.

Figure 3:
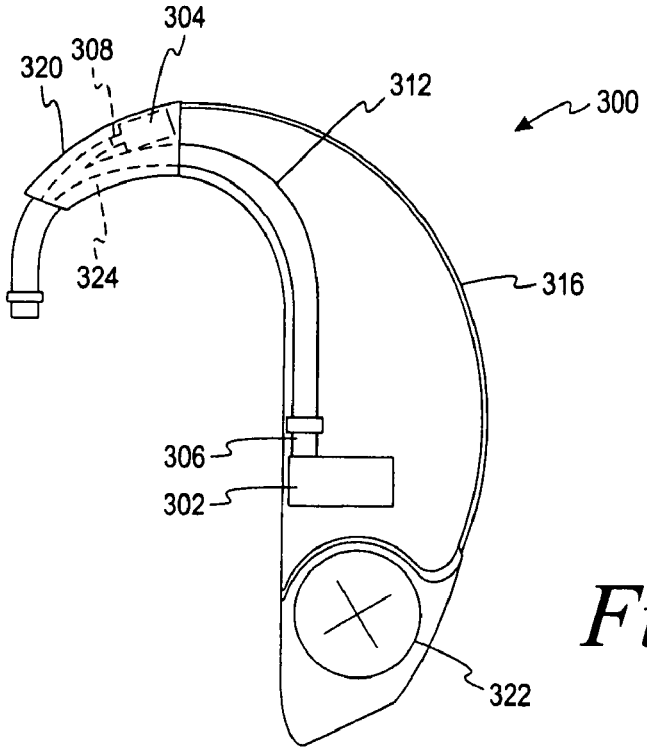
FIG. 3 is a variation of the hearing aid shown in FIG. 2 in which the high-frequency receiver is disposed in the earhook.

An alternate embodiment is shown in FIG. 3 wherein a high-frequency receiver 304 is placed inside an earhook 320 of a hearing aid 300. Because the high-frequency receiver 304 only has to provide high frequencies (or very high frequencies such as above 7 kHz), it can be made small enough to fit inside the earhook 320. The high-frequency receiver 304 may have a generally rectangular or cylindrical shape sized to fit within the earhook 320.

Figure 4A:
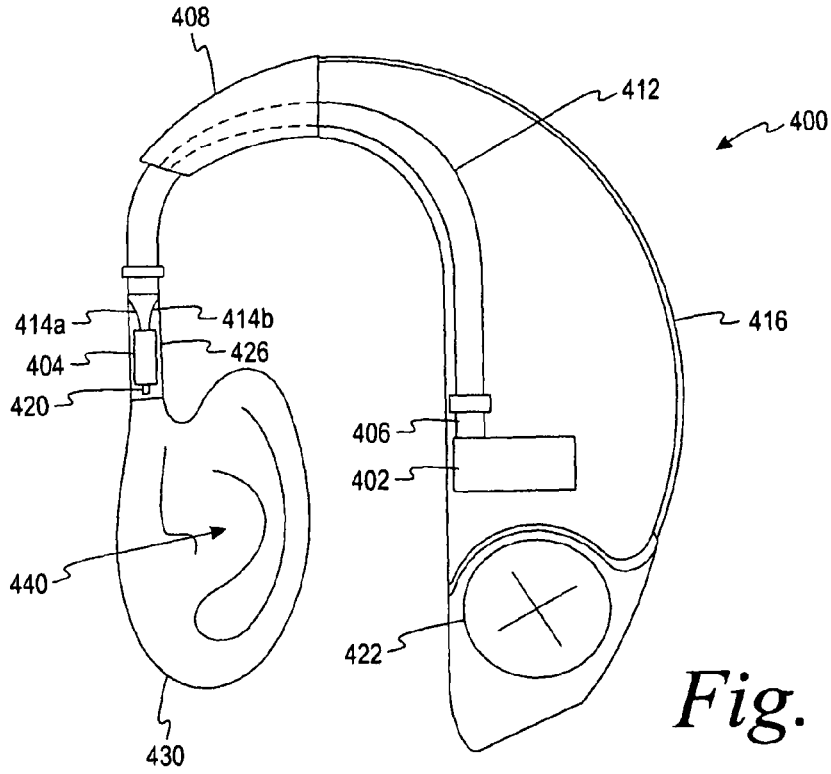
FIG. 4*a* is an illustration of a hearing aid shell with an earmold connected to the earhook of the hearing aid, a high-frequency receiver being disposed within a tube connecting the earmold.
Figure 5A:
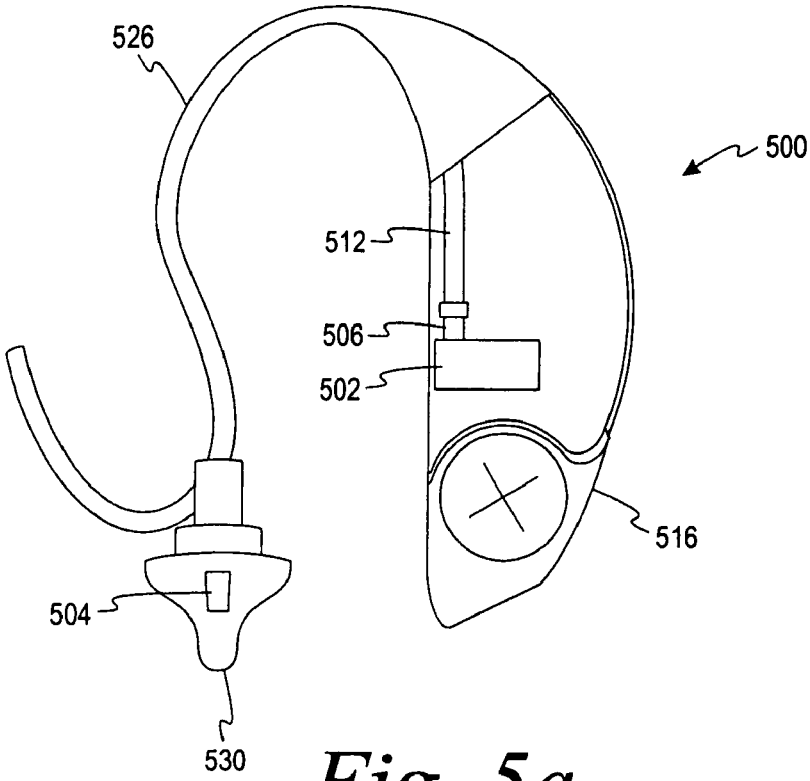
FIG. 5*a* is an illustration of an "open ear" type hearing aid having a high-frequency receiver disposed in an earbud tethered to the hearing aid shell by a tube, which is coupled to a low-frequency receiver inside the housing by a tube, according to an embodiment of the present invention.

FIG. 4*a* illustrates another embodiment in which a high-frequency receiver 404 is placed in an earmold tube 426 of a hearing aid 400, which is of the behind-the-ear (BTE) type having a closed-fitting earmold 430 (alternately, the high-frequency receiver 404 may be placed in or near the earpiece tip of an open-fit hearing aid, which is placed in the ear canal, such as shown in FIG. 5*a* below). The earmold tube 426 connects an earhook 408 of the hearing aid 400 to the earmold 430. Wires 414*a,b* connected to the high-frequency receiver 404 extend away therefrom and connect to electrodes disposed in the earmold tube 426. The hearing aid 400 includes a housing 416 that houses a low-frequency receiver 402 having an output port 406 connected to a tube 412 extending through the earhook 408 and connecting to the earmold tube 426. An output port 420 of the high-frequency receiver 404 is much closer to the ear canal than the low-frequency receiver 402.

Figure 4B:
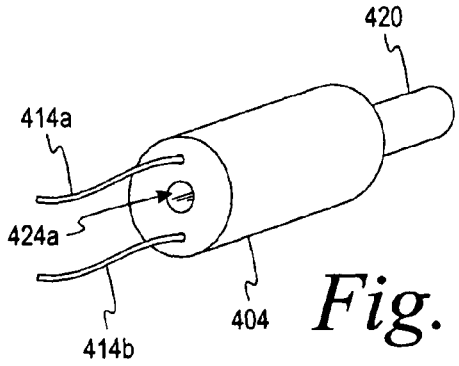
FIG. 4*b* is a perspective illustration of a high-frequency receiver having a cylindrical shape with a channel formed therethrough and a protruding output port according to an embodiment of the present invention.
Figure 4C:
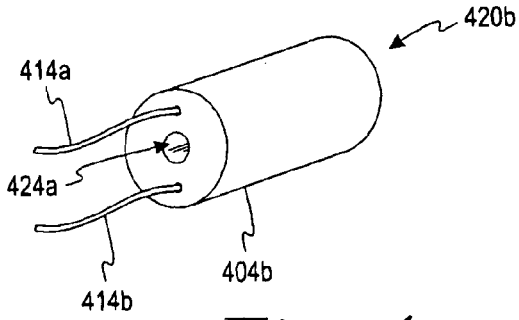
FIG. 4*c* is a perspective illustration of a cylindrically shaped high-frequency receiver having a channel formed therethrough without a protruding output port according to another embodiment of the present invention.

The high-frequency receiver 404 is shown in FIGS. 4*b* and 4*c* as having a substantially cylindrical shape. In FIG. 4*c*, the output port 420*b* of high-frequency receiver 404*b* does not protrude as in FIG. 4*b*. A cylindrically shaped receiver suitable for this embodiment is disclosed in commonly owned, copending U.S. patent application Ser. No. 09/992,253, entitled Acoustical Receiver Housing for Hearing Aids, filed Nov. 16, 2001, published as U.S. Patent Application Publication No. 2002/0061113 on May 23, 2002, which is incorporated herein by reference in its entirety. The receiver shown in FIGS. 7*a* and 7*b* of Publication No. 2002/0061113 can be made smaller because it would be optimized for high frequencies only. Either receiver 404 or 404*b* shown in FIGS. 4*b* and 4*c* is suitable for use in the hearing aid 400 shown in FIG. 4*a*. The high-frequency receivers 404, 404*b* include a channel 424*a*, 424*b*, respectively, running through the center of the length of the receivers. The channels 424*a,b* permit the low-frequency sounds from the upstream low-frequency receiver 402 to pass through the receiver 404, 404*b*. The low-frequency acoustic sounds are combined with high-frequency acoustic sounds outputted by the output port 420, 420*b*, to form a full-range acoustic sound that is transmitted to the wearer's ear canal.

Figure 4D:
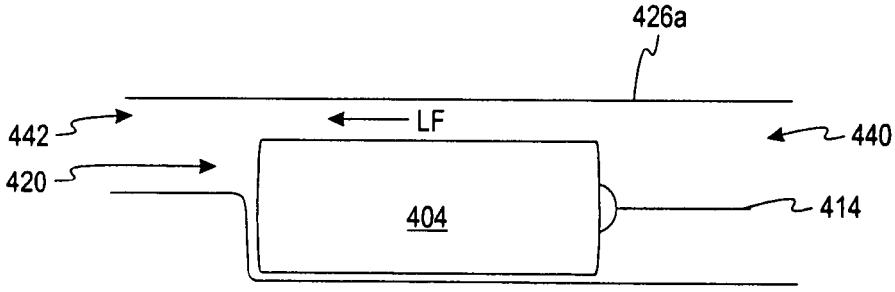
FIG. 4*d* is an illustration of a side view of a high-frequency receiver disposed within a tube such that there is space for low frequency sounds to flow past the high-frequency receiver according to an embodiment of the present invention.

FIG. 4*d* is an illustration of a high-frequency receiver 404, which may have a rectangular or cylindrical shape, disposed within a shaped tube 426*a* having a recessed area for receiving the high-frequency receiver 404 as shown. Low frequency acoustic sounds enter the shaped tube 426*a* at tube input 440 and pass around the high-frequency receiver 404 in the direction of arrow LF. High frequency acoustic sounds are combined with the low frequency acoustic sounds at the output port 420 of the high-frequency receiver 404, and together they leave the tube 426*a* at tube output 442 as a full-range acoustic sound. The wires 414 pass through the tube 426*a* and are connected as described above either to electrodes disposed along the tube 426*a* or at the interface of an acoustical/electrical connector that creates an acoustic seal as well as providing electrical connectivity for the wires 414 to the hearing-aid electronics.

Figure 4E:
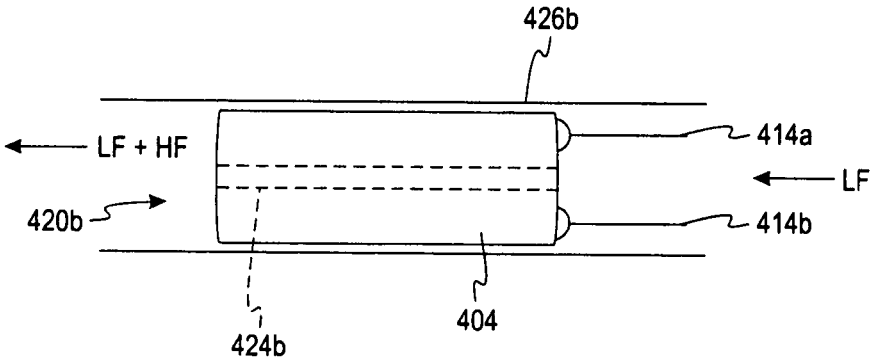
FIG. 4*e* is a variation of FIG. 4*d* in which the high-frequency receiver includes a channel formed therethrough for allowing the low frequency sounds to pass therethrough according to another embodiment of the present invention.

The high-frequency receiver 404 shown in FIG. 4*e* has a substantially cylindrical shape and fits snugly within a tube 426*b*. Upstream low-frequency acoustic sounds pass through the tube in the direction of arrow LF and also through the high-frequency receiver 404 via the channel 424*b* and are combined with the high-frequency acoustic sounds outputted by the high-frequency receiver 404 at its output port 420*b* to form a full-range acoustic signal that is transmitted to the wearer's ear canal in the direction of arrow LF+HF. Wires 414*a,b* pass through the tube 426*b* and carry the driver signals to the high-frequency receiver 404. The wires 414*a,b* are connected upstream either at a connector interface that offers both acoustical sealing and electrical connectivity or along an electrode formed along the tube 426*b* as discussed above. Alternatively, two high-frequency receivers 404 (each operational at a specific range) can be placed in the tube 426*b* with space left between the receivers for passing the LF signal.

The embodiments shown in FIGS. 4*d* and 4*e* do not require that the high-frequency receiver 404 include stand-offs to orient and position it within the tube 426*a,b*. In alternate embodiments, the high-frequency receiver 404 may include stand-offs such as shown and described in connection with FIGS. 1*a*-1*c*.

The closed-fitting design allows the high-frequency receiver to be placed outside of the ear. Such placement advantageously avoids the adverse effects of ear wax and other intra-ear obstructions that can degrade receiver performance.

The present invention offers great flexibility in positioning the high-frequency receiver. The low-frequency receiver, when placed in the hearing-aid shell, can be large and powerful for outputting low frequency acoustic sounds. Its compliance can be optimized independently of the high-frequency receiver, which can be optimized for the smallest possible size and lowest possible mass independently of the low-frequency receiver. The high-frequency receiver can be placed so that it sits just behind the wearer's tragus, such as in area 440 shown in FIG. 4*a*. The high-frequency receiver can be colored black or a skin-color-matching plastic or coating can surround the receiver to blend with the wearer's skin color, rendering the receiver nearly invisible.

Figure 4F:
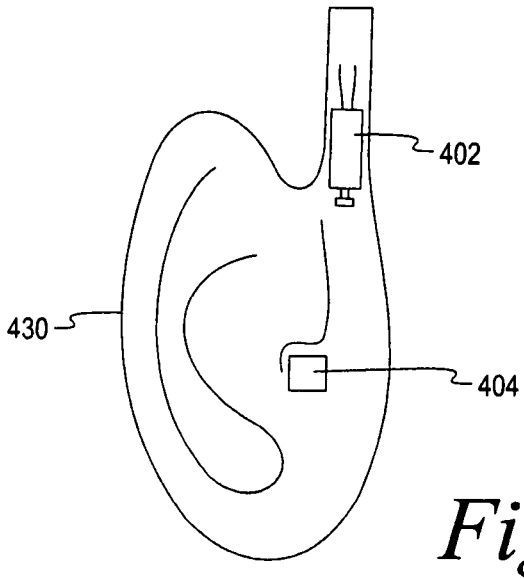
FIG. 4*f* is an illustration of an earmold having two receivers, one placed so that it fits just behind the wearer's tragus.

In another embodiment shown in FIG. 4*f*, the low-frequency receiver 402 is placed in the earmold 430 and the high-frequency receiver 404 is placed near the tragus (an end view is shown in FIG. 4*f* such that the receiver 404 is oriented towards the wearer's ear canal), which is the small piece of skin-covered cartilage that protrudes slightly over the entrance to the ear canal. In such an embodiment, a sound tube would lead from the earmold 430 to the high-frequency receiver. A receiver roughly the size of an FK-series receiver commercially available from Knowles Electronics has been found to fit nicely behind the tragus, and, of course, smaller receivers would fit as well.

An open-fit design of an OTE/BTE hearing aid 500 is shown in which a high-frequency receiver 504 is placed within an earbud 530 that is tethered to a shell 516 of the hearing aid 500 by an earbud tube 526 that carries the wires connected to the high-frequency receiver 504 to electronics (not shown) within the shell 516. A block diagram of electronics suitable for use in connection with embodiments of the present invention is shown and described in connection with FIG. 6 below.

The shell 516 houses a low-frequency receiver 502 having an output port 506 for outputting low-frequency acoustic sounds to a tube 512 that is connected to the earbud tube 526. Low frequency acoustic sounds outputted by the low-frequency receiver 502 travel through the tubes 512, 526 and are combined with the high frequency acoustic sounds outputted by the high-frequency receiver 504 in the earbud 530.

As is known with open fittings, sounds at the high frequencies tend to leak out, creating a loss of range at the high frequencies for the listener. However, the present invention minimizes this adverse effect in open-fittings in that the high-frequency receiver can be disposed deep within the ear canal in open-fit designs, and high frequencies do not suffer by virtue of having to travel through a long tube. The adverse effects of feedback are also effectively counteracted by the present invention because the high-frequency receiver can be located far away from the microphone.

Figure 5B:
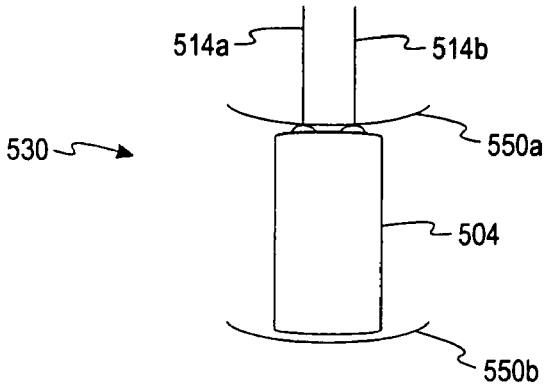
FIG. 5*b* is an illustration of a high-frequency receiver having a size adapted to fit within double plastic earbuds according to an embodiment of the present invention.

The earbud 530 may be a double-plastic earbud that permits deep insertion of the earbud 530 into the ear canal, achieving a much better high-frequency reduction of the sound that goes outside. The high-frequency receiver 504 can be wedged between the plastic pieces 550*a,b* of the double-plastic earbud 530 such as shown in FIG. 5*b*.

Figure 6:
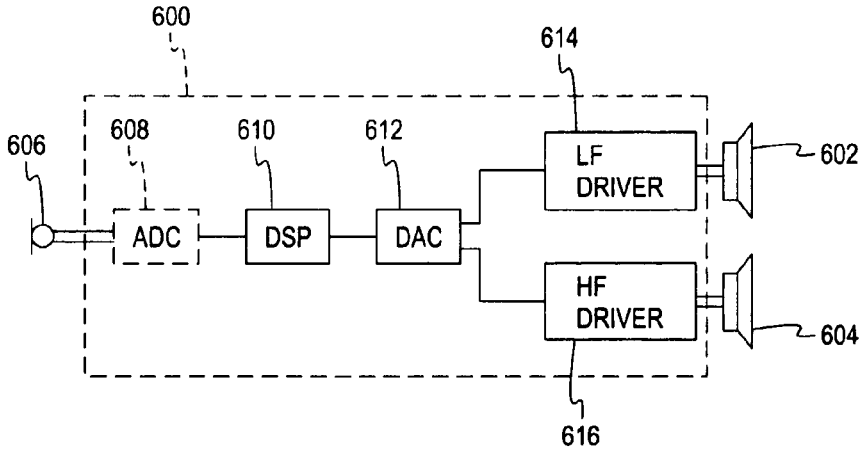
FIG. 6 is a functional block diagram of electronics suitable for use in embodiments of the present invention.

FIG. 6 is a functional block diagram of electronics 600 suitable for use in connection with embodiments of the present invention. The electronics include an optional analog-to-digital converter 608, a digital signal processor (DSP) 610, a digital-to-analog converter 612, a low-frequency amplifier or driver 614, and a high-frequency driver or amplifier 616. Note that the foregoing components may be disposed on separate substrates or on a single substrate or any combination of substrates. The optional ADC 608 is connected to a microphone 606, which may output an analog audio signal (in which embodiment the ADC 608 would be used) or it may output a digital audio signal (in which embodiment the ADC 608 would not be needed). The microphone 606 may be a digital MEMS microphone, such as the DigiSiMic™, or an analog silicon-based microphone, such as the SiMic™, both of which are available from Sonion MEMS A/S. Alternately, the microphone 606 may be any conventional silicon or non-silicon-based microphone.

The low-frequency driver 614 is connected to a low-frequency receiver 602 and is specially optimized for outputting low-frequency audio signals that are converted into corresponding low-frequency acoustic sounds by the low-frequency receiver 602. Likewise, the high-frequency driver 616 is connected to a high-frequency receiver 604 that is physically separate from the low-frequency receiver 602 and is specially optimized for outputting high-frequency audio signals that are converted into corresponding high-frequency acoustic sounds by the high-frequency receiver 604. The electronics 600 are housed within the shell of the hearing aid, which may be of the ITC (in the canal, which is widely used), MIC (mostly in the canal), CIC (completely in the canal), ITE (in the ear), BTE (behind the ear), or OTE (over the ear or open fit) types.

In various embodiments, the DSP 610 can be clocked for "normal" band or wideband frequency ranges. For example, the DSP 610 may be clocked with a resulting bandwidth of 6 kHz rate for normal band, or can be clocked higher to result in to 12 kHz or 16 kHz for wideband.

The high-frequency receivers according to the embodiments of the present invention are generally cylindrical or rectangular in shape, and may be of the following types: balanced armature, moving coil, piezo. Moving coil receivers have higher efficiency for high frequencies as compared to low frequencies, so moving coil receivers could be more advantageous for high-frequency optimization. For low outputs, it may be more advantageous to utilize a piezo-type receiver. If efficiency is not the main driver (such as in the design of rechargeable hearing aids), the low-frequency receiver may be of the moving coil type. Use of a balanced armature-type receiver for the low-frequency receiver, the low-frequency efficiency can be increased while lowering compliance and distortion (thicker armature, less saturation).

Though most embodiments described herein are targeted at wideband (e.g., up to 10 kHz) hearing aids, the present invention in other embodiments can also be applied to hearing aids with limited or "normal" bandwidth. For example, in a limited-bandwidth embodiment, a super-power hearing aid includes a low-frequency receiver in its shell that generates frequencies up to around 1 kHz or 1.5 kHz. A high-frequency receiver in the earmold or earbud generates frequencies from the 1 or 1.5 kHz to around 3.5 kHz range. In this embodiment, the hearing aid can be optimized for optimal feedback suppression because the feedback-generating high frequencies are generated far away from the microphone(s). The low-frequency receiver can be optimized for a lower mechanical resonance frequency, resulting in higher efficiency for the low frequencies and high output as well.

Figure 7:
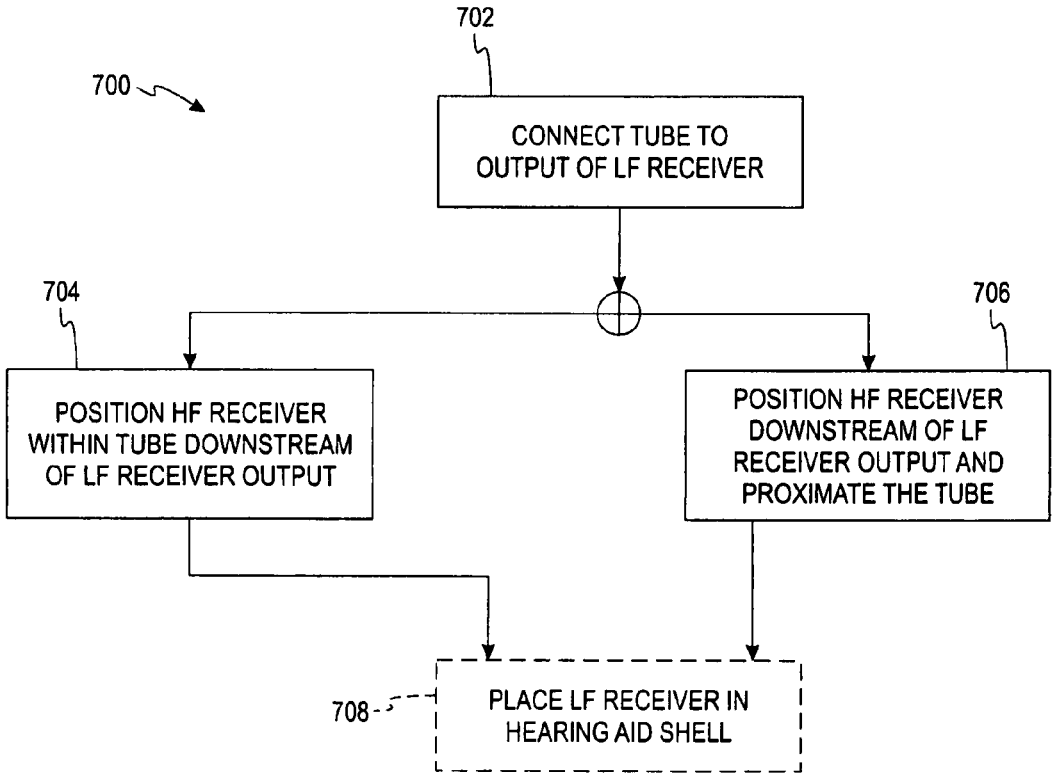
FIG. 7 is a flow-chart diagram of alternate methods according to embodiments of the present invention.

FIG. 7 illustrates a flow-chart diagram of a method 700 according to embodiments of the present invention. A tube is connected to the output of a low-frequency (LF) receiver (702). A high-frequency (HF) receiver is positioned within the tube downstream of the LF receiver output, or, alternately, the HF receiver is positioned downstream of the LF receiver output and proximate the tube (instead of within the tube) (706). Optionally, the LF receiver is placed in a hearing-aid shell. According to the method 700, the LF receiver and the HF receiver are physically separate and distant from one another.

Although one more component is used (a second receiver) as compared with conventional hearing aid designs, the present invention counter-intuitively allows space to be optimized, resulting in a smaller overall hearing aid. This is because the tubing allows the low-frequency receiver's orientation to be optimized, without regard for the orientation's effect on high frequencies, for best use of space within the hearing-aid shell. The tubing from the low-frequency receiver can be made longer if needed because only high frequencies are adversely affected by the tubing length.

Each of these embodiments and obvious variations thereof is contemplated as falling within the spirit and scope of the claimed invention, which is set forth in the following claims.

The invention claimed is:

1. A receiver system for a hearing aid, comprising:

a housing;

a first receiver in said housing, said first receiver amplifying low frequency sounds in at least the audible frequency range and having a first output port for outputting low-frequency sounds;

a sound tube in said housing and connected to said first output port; and a second receiver at least partially in said sound tube positioned downstream of said first output port, said second receiver amplifying high frequency sounds in at least the audible frequency range.

2. The receiver system of claim 1, wherein said second receiver comprises standoffs that abut against the inner wall of said sound tube such that said low-frequency sounds propagate around said second receiver towards a sound outlet of the receiver system.

3. The receiver system of claim 2, wherein said second receiver has a generally cylindrical shape.

4. The receiver system of claim 1, wherein the low frequency sounds include frequencies up to at least 1 kHz.

5. The receiver system of claim 4, wherein the high frequency sounds include frequencies above about 3 kHz.

6. The receiver system of claim 4, wherein the high frequency sounds include frequencies above 9 kHz.

7. The receiver system of claim 1, wherein the hearing aid is an in-the-ear type of hearing aid.

8. The receiver system of claim 1, wherein said second receiver has a generally cylindrical shape, said second receiver having a channel formed through a center of said second receiver such that said low-frequency sounds propagate through said second receiver via said channel.

9. A hearing aid assembly, comprising:

a housing including a first receiver for producing low-frequency sound and a sound tube acoustically connected to an output port of said first receiver;

a second receiver outside of said housing and acoustically coupled to said first receiver, said second receiver producing high-frequency sound; and an earmold tube connected between an earhook of said hearing aid and an earmold, said earmold tube being acoustically connected to said sound tube, said second receiver being disposed at least partially within said earmold tube, wherein said second receiver is positioned within said earmold tube such that said low-frequency sound produced by said first receiver propagate around said second receiver and is combined with said high-frequency sound produced by said second receiver.

10. A hearing aid assembly, comprising:

a housing including a first receiver for producing low-frequency sound and a sound tube acoustically connected to an output port of said first receiver;

a second receiver outside of said housing and acoustically coupled to said first receiver, said second receiver producing high-frequency sound; and an earmold tube connected between an earhook of said hearing aid and an earmold, said earmold tube being acoustically connected to said sound tube, said second receiver being disposed at least partially within said earmold tube, wherein said second receiver has a generally cylindrical shape and a channel passing through said second receiver, said second receiver being positioned within said earmold tube to abut the inner wall of said earmold tube, said low-frequency sound produced by said first receiver passing through said channel to be combined with said high-frequency sound produced by said second receiver.

* * * * *